US007832155B1

(12) United States Patent
Shea

(10) Patent No.: US 7,832,155 B1
(45) Date of Patent: Nov. 16, 2010

(54) DROP FLOOR CONSTRUCTION AND METHOD FOR PARK MODEL HOME

(75) Inventor: James Shea, Mishawaka, IN (US)

(73) Assignee: Fairmont Homes, Inc., Nappanee, IN (US)

( * ) Notice: Subject to any disclaimer, the term of this patent is extended or adjusted under 35 U.S.C. 154(b) by 56 days.

(21) Appl. No.: 11/924,907

(22) Filed: Oct. 26, 2007

(51) Int. Cl.
*E04B 1/34* (2006.01)

(52) U.S. Cl. ..... 52/143; 52/653.1; 280/789; 280/799; 280/798

(58) Field of Classification Search ..... 52/143, 52/653.1, DIG. 11; 280/789, 799, 798, 781
See application file for complete search history.

(56) References Cited

U.S. PATENT DOCUMENTS 5,353,558 A * 10/1994 Shea et al. ..... 52/143
6,299,229 B1 * 10/2001 Becenas Nieto ..... 296/24.3
6,343,830 B1 * 2/2002 Ingram et al. ..... 296/168
6,447,048 B2 * 9/2002 Crean ..... 296/168
6,729,678 B1 * 5/2004 Atcravi ..... 296/168
7,065,926 B2 * 6/2006 Brandt et al. ..... 52/143
7,191,567 B2 * 3/2007 Brandt et al. ..... 52/143

* cited by examiner

*Primary Examiner*—Richard E Chilcot, Jr.
*Assistant Examiner*—Mark R Wendell
(74) *Attorney, Agent, or Firm*—Botkin & Hall, LLP

(57) ABSTRACT

A drop floor for a mobile home or a park model home creates additional space and headroom between the ceiling and floor. A home built according to the invention typically includes a frame supported upon an axle. The frame has numerous cross members extending between a pair of opposite side members and includes a first portion located at a first height with respect to the axle and a second portion located at a second height below the first height. A building structure is supported on the first and second frame portions. The invention includes a drop floor construction method where floor decking is attached to the second portion of the frame so that the floor decking is in contact with the frame and located at the second height, which is below the first height. The drop floor includes nailers, closure material and insulation so that the drop floor can rest upon the ground surface if desired.

5 Claims, 5 Drawing Sheets

DROP FLOOR CONSTRUCTION AND METHOD FOR PARK MODEL HOME

BACKGROUND OF THE INVENTION

1. Field of the Invention

The invention relates to alternative housing structures such as mobile homes, park model homes and modular homes and, more particularly, to a drop floor construction in a park model or mobile home and method for making a drop floor.

2. Description of the Background of the Invention

Mobile homes have been an economically viable housing option for many years. The typical mobile home is constructed on a frame supported by a wheel and axle assembly so the unit can be towed and parked as desired. The wheels beneath the mobile home are typically not removed and as such, the unit may at any time be coupled to a suitable towing vehicle and transported, even when the unit is otherwise parked with blocks or jacks positioned underneath it for added stability. The wheels of park model homes, on the other hand, are removed once the unit is parked.

Park model homes also are distinguishable from mobile homes because they more closely resemble traditionally built homes. A park model may include an upstairs, for example. The more home-like structure is preferable given the choice between mobile units. In recent years, park model homes have become increasingly desirable as vacation homes as a result. It's now common to see these dwellings spotting the landscape near lakes, recreational parks and other such desirable locations. Like their mobile counterparts, however, park model units have to be towed on federal and state roads to their set up location.

Accordingly, like mobile homes, the size of a park model is governed by state and federal guidelines. Specifically, under the Recreational Park Trailer Industry Association (RPTIA) rules, the perimeter of a typical park trailer, or park model, may not exceed 435 square feet. This criterion by happenstance defines one area of innovation for the park model home manufacturer: How to maximize the usable space within a park model home while meeting RPTIA standards.

There therefore remains a need for an improved park model or mobile home, which construction provides increased space and headroom within the home while meeting federal and state guidelines. The present invention is directed toward meeting this need.

SUMMARY OF THE INVENTION

The present invention relates to a mobile home or park model with a drop floor. The park model or mobile home includes an axle with wheels rotatably mounted on the axle. A frame is supported on the axle, and the frame includes a plurality of cross members extending between side members. The frame includes a first portion located at a first height with respect to the axle. A first portion of a building structure is supported on the first portion of the frame. The frame includes a second portion located at a second height below the first height for supporting a second portion of the building structure. Each of the first and second portions of the building structure includes a floor; and a ceiling is supported above the floor of the first and second portions.

In one aspect of the invention, the distance between the floor of the first portion of the building structure and the ceiling is less than the distance between the floor of the second portion of the building structure and the ceiling. The building structure may include a loft supported between the floor and the ceiling. Floor decking may be attached to the second portion of the frame so that the floor of the second portion of the building structure is located at the second height to define a drop floor.

In yet another aspect of the invention, a method for constructing a drop-floor for a mobile home or park model is provided. The mobile home or park model includes a building structure supported by a frame on an axle and wheel assembly. The frame includes a first portion located at a first height with respect to the axle. The frame also includes opposite side members and a plurality of cross members extending between the side members. The method for constructing the drop-floor includes the steps of providing a second portion of the frame located at a second height below the first height and attaching floor decking to the second portion of the frame so that the floor decking is in contact with the second portion of the frame and is located below the first height at the second height so that the floor decking and the frame define an enclosure with an open underside.

The method may include the step of securing closure material to the frame to close the open underside. Wooden nailers may extend between the side members of the second portion of the frame. The closure material may be formed from plastic or metal.

In still another aspect, the cross members extending between the side rails of the second portion of the frame may include a Z-shaped cross section that defines a space with an overhanging upper ledge. The nailers may reside in, respectively, the space of a corresponding one of the cross members, and each of the nailers may include a portion protruding from underneath the upper ledge in order to receive fasteners for attaching the floor decking to the second portion of the frame. The second portion of the frame may include laterally and outwardly extending outriggers.

In yet another aspect, the side rails of the frame may be formed from steel tubes having an interior, and the interior of the tubes may be filled with insulation. Adhesive may be applied between the floor decking and the frame.

One object of the present invention is to provide an improved park model or mobile home, which building structure includes a drop floor so that additional space or head room is created between the floor and the ceiling. Related objects and advantages of the present invention will be apparent from the following description.

DETAILED DESCRIPTION OF INVENTION

Figure 1:
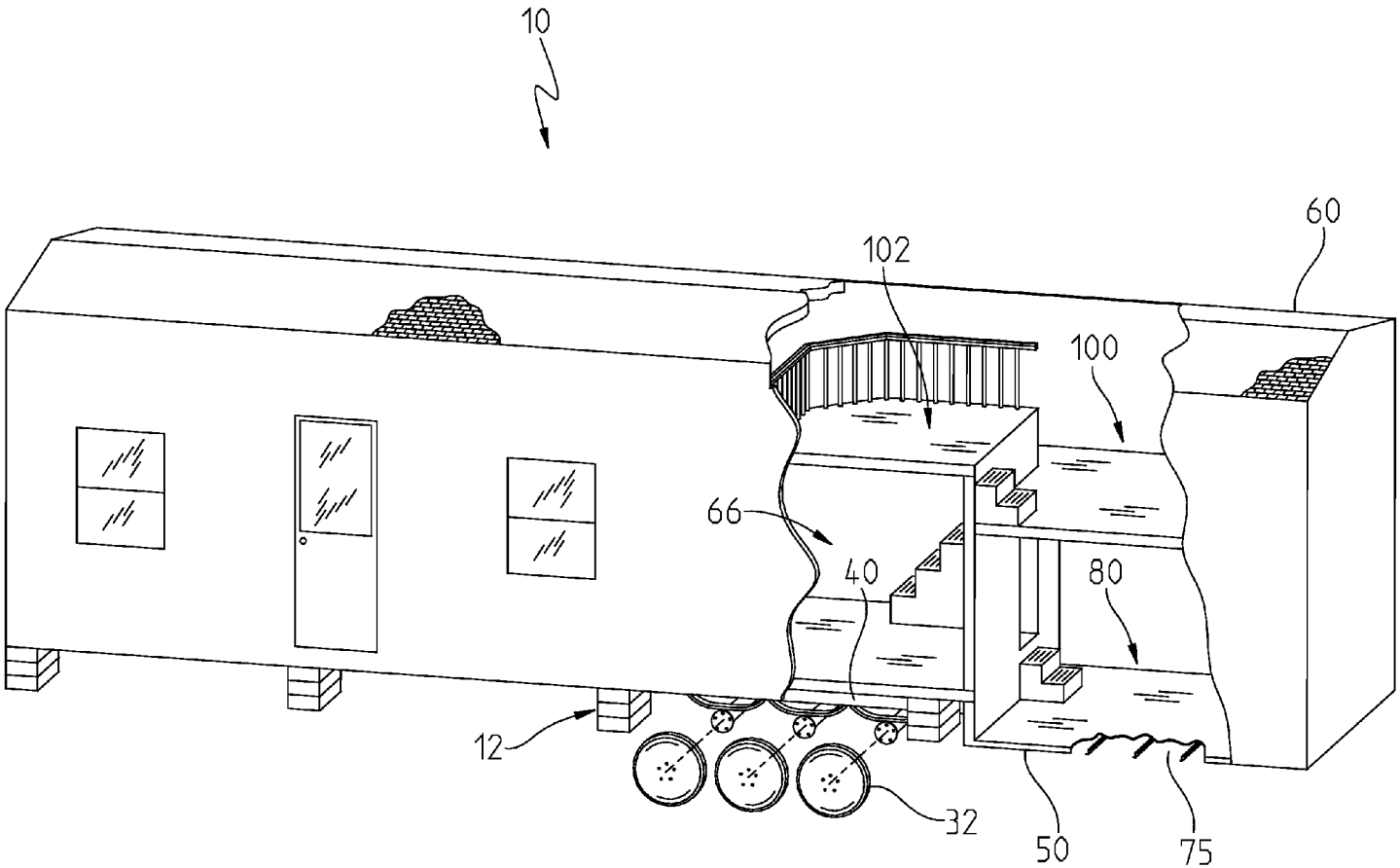
FIG. 1 is a partial cutaway perspective view of a park model home with a loft showing an embodiment of the drop floor of the invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

This invention is useful for mobile homes and park model homes. The drawings and description that follow present only a park model application and therefore should be considered illustrative and not restrictive in this connection.

With reference to the figures, the park model home 10 includes a drop floor 20 to increase the head room within the home. In the example illustrated, the model home 10 includes an axel 30 with wheels 32 rotatably mounted on the axel. The axel 30 supports a frame 40, which is the foundation of the park model 10. The frame has a plurality of cross members 43 extending between a pair of side members 41, 41'. The frame is typically formed from steel. In one embodiment, the frame includes eight-inch I-beam side members 41, steel cross members 43 spaced thirty-two inches apart and thirteen gauge steel outriggers 110. In another embodiment, cross members 43 are spaced sixteen inches apart.

Figure 5:
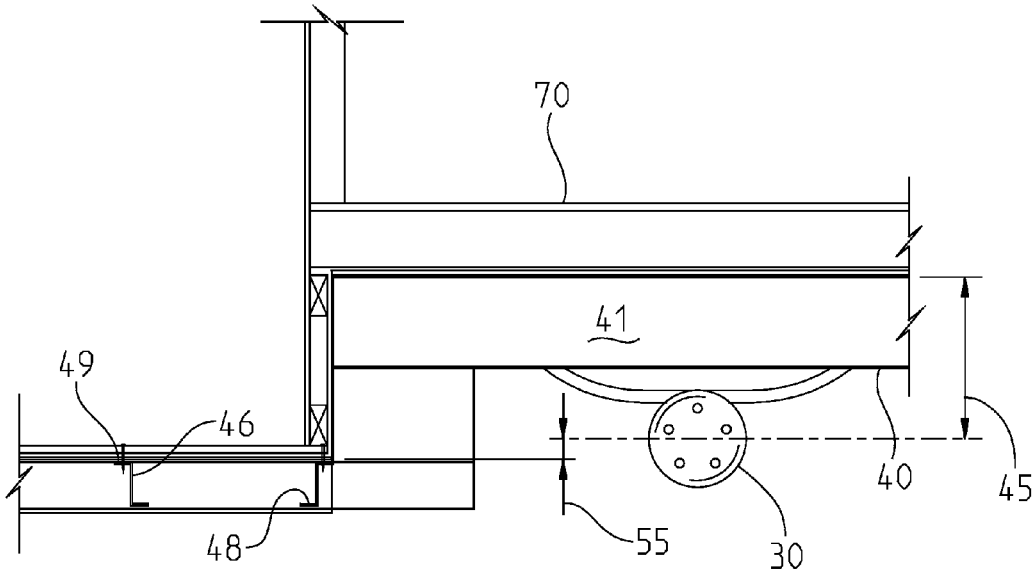
FIG. 5 is a partial side cross-section of an embodiment of the drop floor of the invention taken along lines 5-5 of FIG. 3 showing the upper floor, the two frame portions and the Z-shaped cross section of the cross members.
Figure 6:
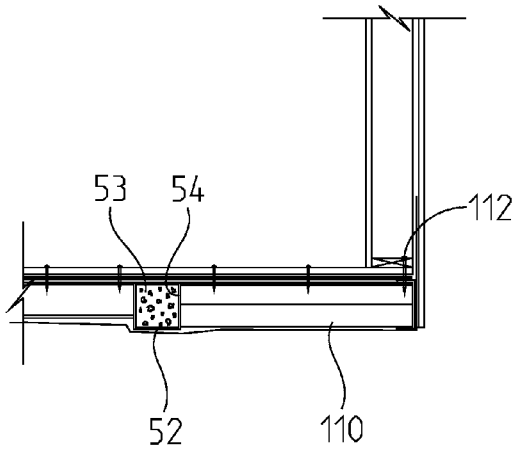
FIG. 6 is a partial end cross-section of an embodiment of the drop floor of the invention taken along lines 6-6 of FIG. 2 showing the second frame portion, floor decking and the tubular side member.

The frame 40 is supported on the axel 30 and includes a first-forward portion 42 and a second portion 50 extending rearward from the first. In one embodiment, the cross members 43 of the first frame portion 42 are spaced thirty-two inches apart and the members 43 of the second frame portion are spaced sixteen inches apart. The first portion 42 of the frame 40 is located at a first height 45 with respect to the axel 30, and the second portion 50 is located at a second height 55 below the first height 45, as shown in FIG. 5. The first portion of the frame supports a corresponding first portion of a building structure 62. The second portion 50 of the frame 40 supports a corresponding second portion 64 of the home building structure 60. The park model home building structure 60 includes a floor 70 covering each of the first and second portions 42, 50 and a ceiling 90 supported above the floor 70.

The building structure 60 may include a loft 100 supported between the drop floor 20 and/or the floor 70 and the ceiling 90. In another embodiment, the building structure 60 may include a second upper loft 102 supported between drop floor 20 and/or floor 70 and the ceiling 90. Access to the lofts 100, 102 is gained via stairs 99, 101.

Figure 3:
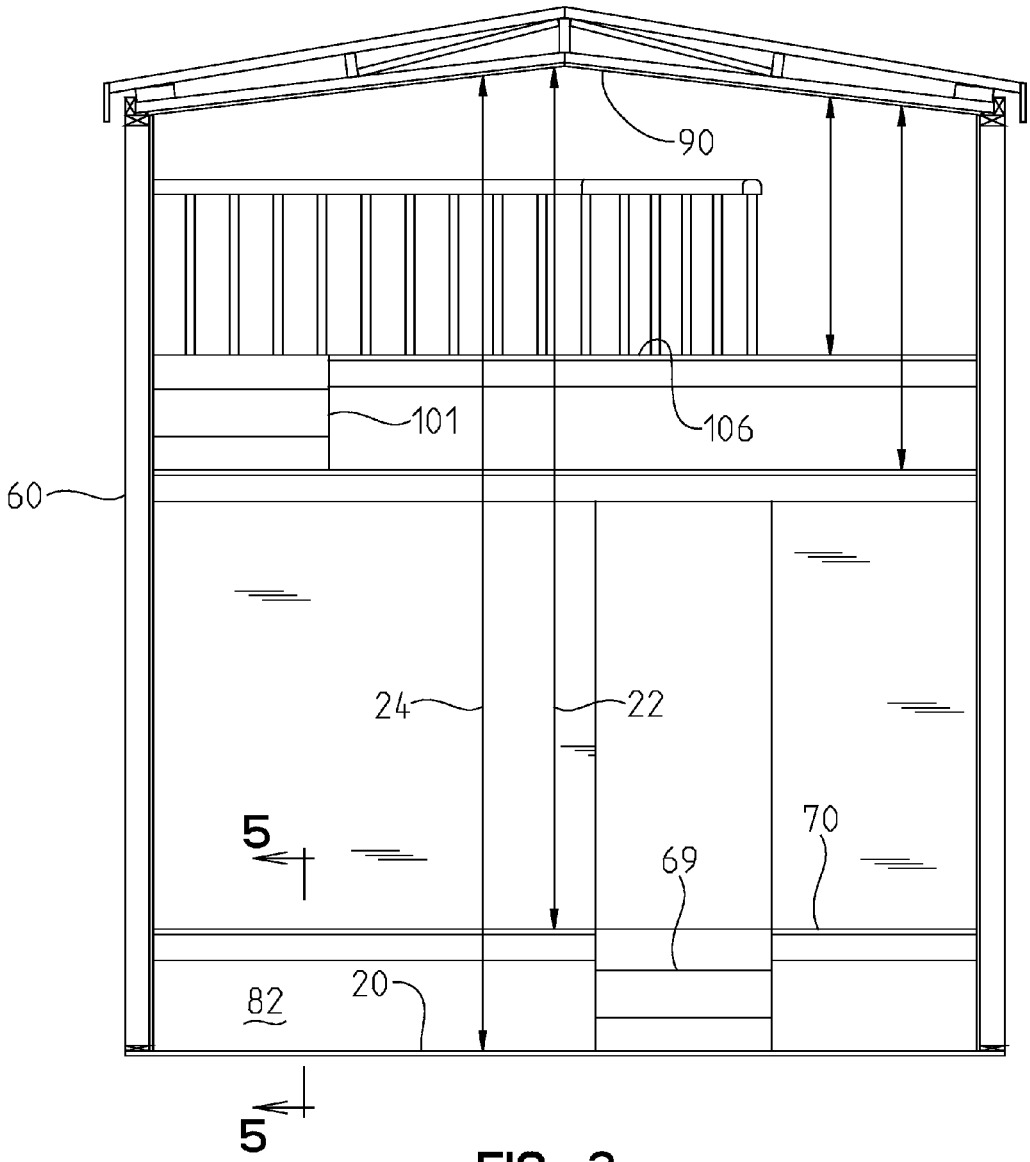
FIG. 3 is a plan view of the end of a park model home with the wall removed to show an embodiment of the drop floor of the invention. The various heights between the floor, the drop floor, and the ceiling and the intervening lofts are shown.

In one embodiment, floor decking 72 is attached to the second portion 50 of the frame 40 so that the floor of the second portion 64 of the building structure 60 is a lower height 55 relative to the axel 30 to define a drop floor 20 of the sunken room 80. Separating the main level and the sunken room is a knee wall 82. Passage to and from the sunken room 80 is achieved by way of stairs 69, as shown in FIG. 3.

Figure 4:
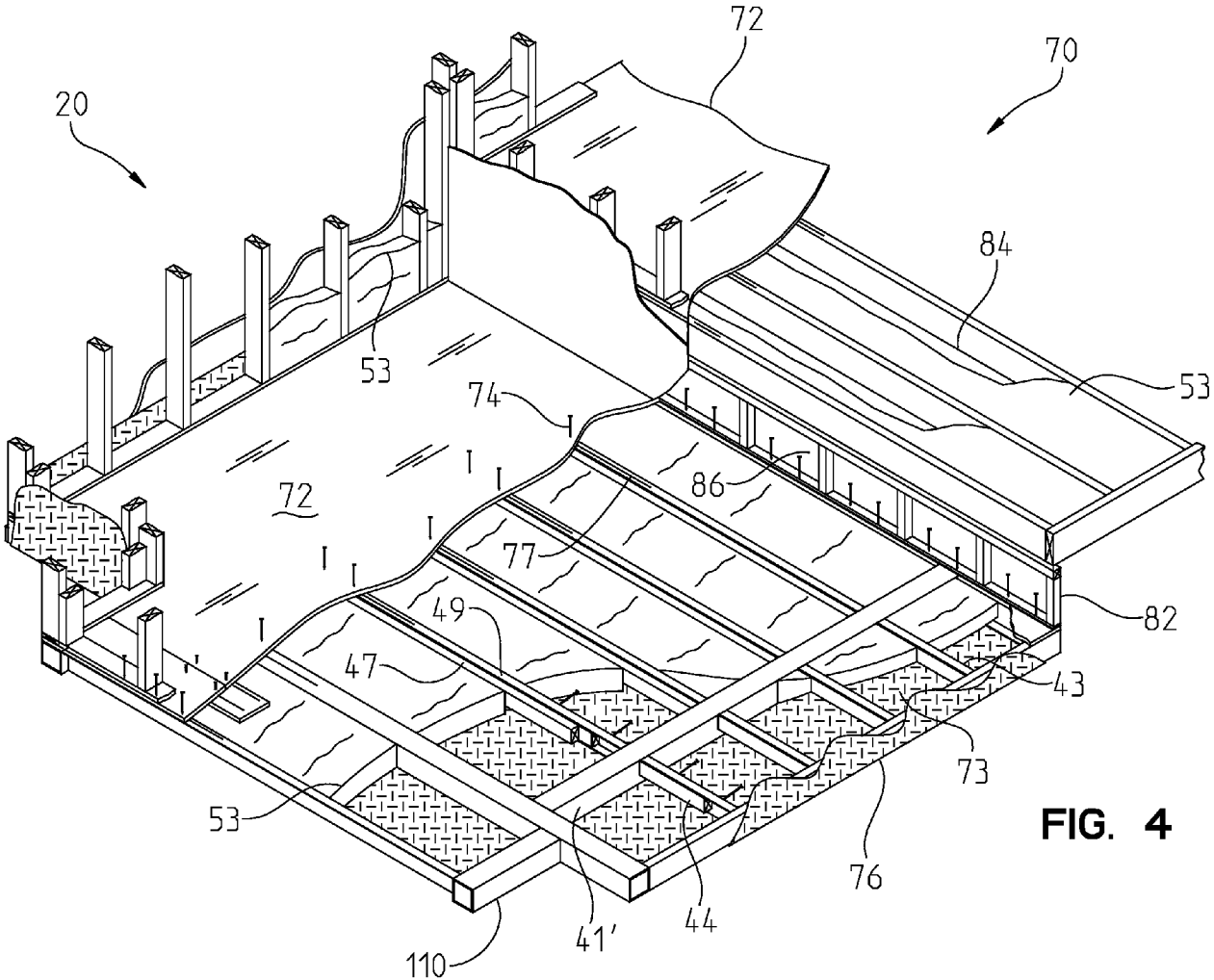
FIG. 4 is a partial cutaway view of an embodiment of the drop floor construction of the invention showing the second frame portion, nailers, floor decking and closure material.

With reference to FIG. 4, in one embodiment, the floor 70 is built on a jig (not shown) to ensure a strong, straight, consistent floor. In that embodiment, a basement style construction is preferable with floor joists 84 sixteen inches on center, extending across frame 40. This creates a wide deep cavity 86 between the side members 41 where waterlines, drain(s) and heat lines (not shown) are installed and insulated. The area is then sealed, completely closed and insulated with insulation 53. The floor decking 72 is then glued and all seams in the floor 70 are fastened with screws 74 or other fasteners to the joists 84.

The completed floor 70 may then be positioned on the frame 40 by an overhead crane where a metal closure material 76 has been installed to seal the underside of the park model 10, which helps prevent animals and other pests from entering the home 10 while it's unoccupied. Once floor 70 has been squared to the frame 40, carriage bolts (not shown) are used at the corners to secure floor 70 to the frame 40. Additional lag bolts 112 are used on each outrigger 110 to further secure the floor 70 to the frame 40.

Referring to FIG. 4, the drop floor 20 construction of the invention includes attaching floor decking 72 directly to the second portion 50 of the frame 40 so that the floor decking is in contact with the frame 40 and located at the second height 55 (FIG. 5) relative to the axle 30 where the floor decking 72 and the second portion 50 of frame 40 define an enclosure 73 with an open underside 75. In one embodiment, wooden nailers 44 extend between the side members 41'. The nailers 44 are positioned in the space 48 beneath the upper ledge 49 of the cross members 43.

In that embodiment, the cross members 43 extending between the side rails 41' of the second portion 50 of the frame 40 have a Z-shaped cross section 46 that defines a space 48 with an over-hanging upper ledge 49. The frame and outriggers 110 include tube steel having an interior 54 filled with insulation 53. The wooden nailers 44 include a portion 47 protruding from underneath the upper ledge 49 in order to receive screws 74 or other fasteners for attaching the floor decking 72 to the second portion 50 of the frame 40. Adhesive 77 may be applied to the surface of the cross members 43 between the floor decking 72 and the frame 50 to further seal the drop floor 20.

Figure 2:
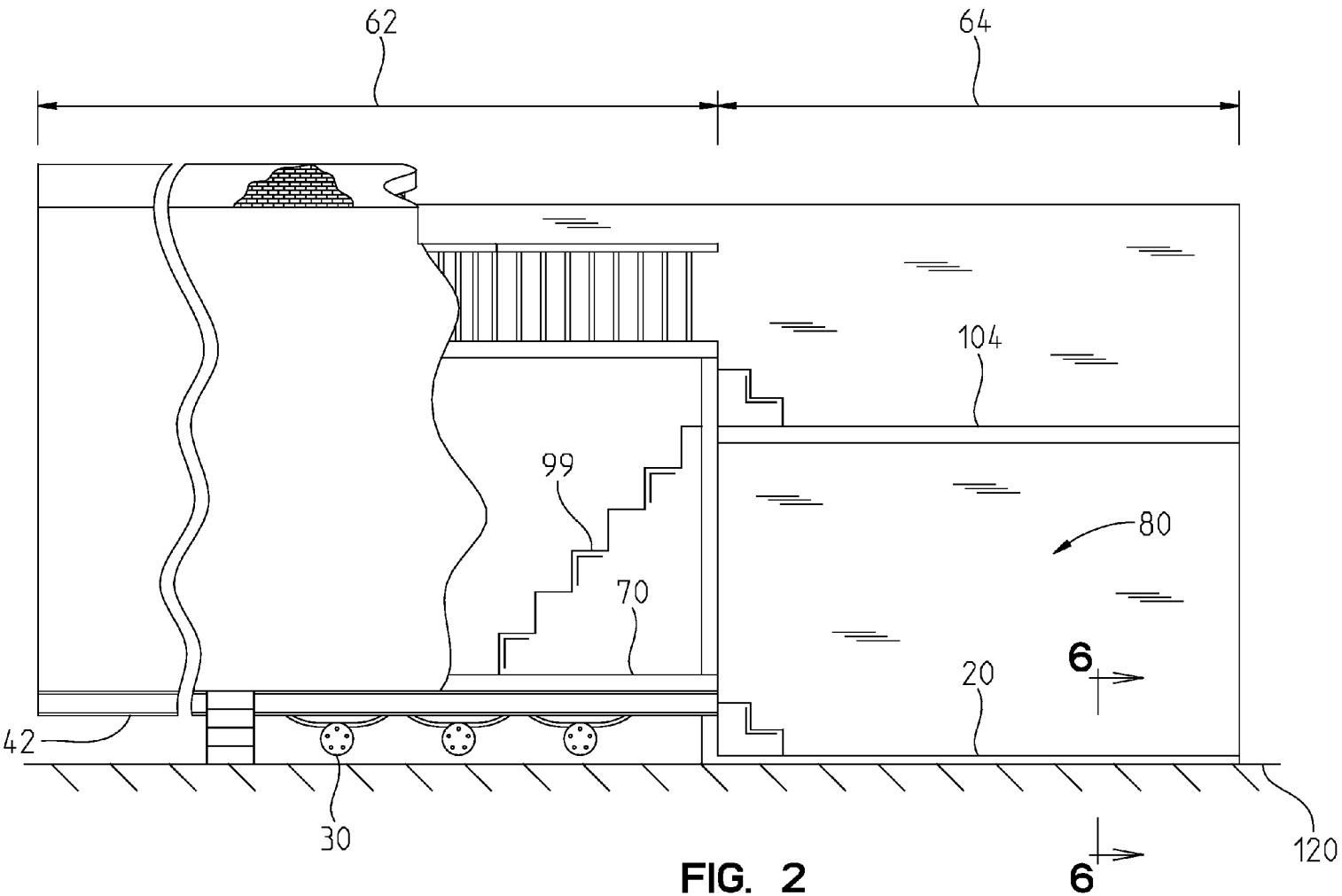
FIG. 2 is a side plan view of a park model home including an embodiment of the drop floor of the invention shown with the wall removed.

The closure material 76 may be wrapped around the underside 75 of the enclosure 73 so that the drop floor 71 can be situated on the ground surface 120, as shown in FIG. 2. During set up, consideration should be given, however, to whether it may be desirable to allow access to any utility cables and other underground conduits that may be covered before placing the home 10 on the ground surface 120. Closure material 76 may be formed from plastic or a rigid material such as aluminum or sheet steel. Preferably, closure material 76 is formed from thirteen gauge steel.

Referring to FIG. 3, the distance 22 between the floor 70 of the first portion 62 of the building structure 60 and the ceiling 90 is less than the distance 24 between the drop floor 20 of the second portion 64 of the building structure 60 and the ceiling 90. The embodiment of the drop floor 20 illustrated produces a park model home 10 having a sunken room so that between two and ten inches of headroom is added to the park model home 10.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Thus, it is understood that it is desirable to protect all the changes in modifications that come within the spirit of the invention.

What is claimed is:

1. A park model or mobile home with a drop floor comprising:

an axle;

wheels rotatably mounted on the axle;

a frame having a plurality of cross members extending between side members, a plurality of said cross members including upper ledges, said frame supported on the axle, said frame including a first portion located at a first height with respect to the axle and supporting thereon a first portion of a building structure, said frame including a second portion located at a second height below the first height for supporting a second portion of the building structure, each of the first and second portions of said building structure includes a floor, wherein floor decking is attached to the second portion of said frame at said cross members so that the floor of the second portion of the building structure is located at said second height to define a drop floor, and boards fitted against said plurality of said cross members of the second portion of the frame under said upper ledges thereof, parts of said boards protruding from under said upper ledges, fasteners extending through said floor decking and into said board parts to secure the decking to said second portion of said frame; and a ceiling supported above the floor of said first and second portions.

2. A home according to claim 1, wherein the distance between the floor of the first portion of the building structure and the ceiling is less than the distance between the floor of the second portion of the building structure and the ceiling.

3. A home according to claim 1, wherein the second portion of the building structure includes a loft supported between the floor and the ceiling.

4. A home according to claim 2, wherein floor decking is attached to the second portion of said frame so that the floor of the second portion of the building structure is located at said second height to define a drop floor.

5. A home according to claim 1 wherein said boards are attached to said plurality of said cross members.

* * * * *